US008783987B2

(12) United States Patent
Kulik

(10) Patent No.: US 8,783,987 B2
(45) Date of Patent: Jul. 22, 2014

(54) WIPER WITH RESILIENT WIPER LAMELLAS

(71) Applicant: GEKA GmbH, Bechhofen (DE)

(72) Inventor: Daniela Kulik, Leipzig (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 13/655,710

(22) Filed: Oct. 19, 2012

(65) Prior Publication Data

US 2013/0101335 A1 Apr. 25, 2013

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)
USPC ..... 401/122

(58) Field of Classification Search
USPC ..... 220/229, 254.2; 401/121, 122
See application file for complete search history.

(56) References Cited

U.S. PATENT DOCUMENTS

| | | | | |
|---|---|---|---|---|
| 2,627,619 | A * | 2/1953 | Gagen | 15/257.05 |
| 6,502,584 | B1 * | 1/2003 | Fordham | 132/218 |
| 6,568,405 | B2 * | 5/2003 | Masuyama | 132/218 |
| 7,387,216 | B1 * | 6/2008 | Smith | 220/254.3 |

* cited by examiner

*Primary Examiner* — David Walczak
*Assistant Examiner* — Joshua Wiljanen
(74) *Attorney, Agent, or Firm* — Setter Roche LLP

(57) ABSTRACT

The invention relates to a wiper for wiping off a cosmetics applicator, in particular a wiper for mascara mass applicators, that includes a retaining section for fixing the wiper on a cosmetics storage container. The wiper includes a number of wiper lamellas that shift in a more than just insubstantial extent in a circumferential direction solely under the influence of forces produced of withdrawal of the applicator.

11 Claims, 4 Drawing Sheets

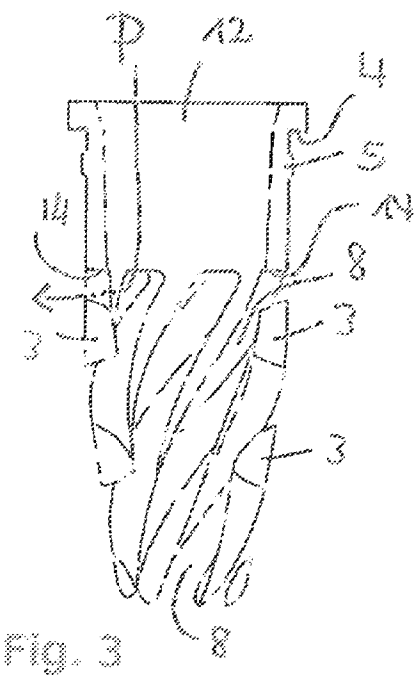
Fig. 3
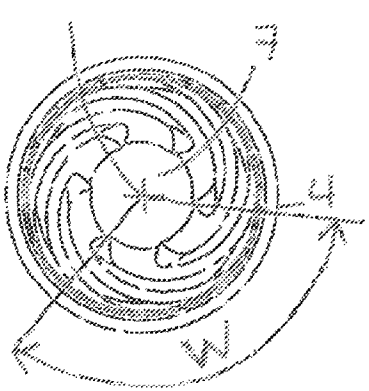
Fig. 5
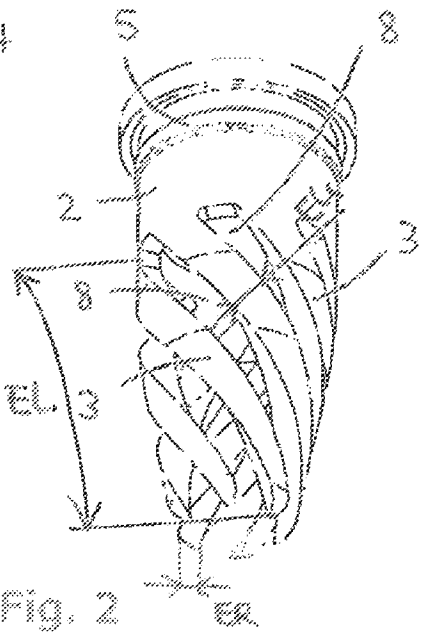
Fig. 2
Fig. 4
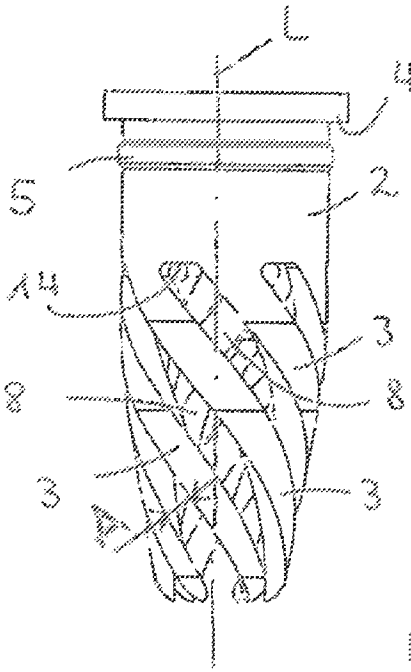
Fig. 1

WIPER WITH RESILIENT WIPER LAMELLAS

FIELD OF THE INVENTION

The invention relates to a wiper. Such a wiper serves for wiping off excess cosmetic mass from an applicator that has been dipped into the cosmetic mass and is then withdrawn from the cosmetics supply through the wiper, in order to apply a certain amount of cosmetic, preferably without any dripping. In particular, the invention relates to a wiper for mascara mass applicators.

BACKGROUND OF THE INVENTION

Various designs of applicators have become known in the prior art. Such applicators are most frequently configured as sleeves or tubular bodies that taper at one end in the manner of a truncated cone, in the broadest sense. The section configured like a truncated cone forms a wiper lip which extends peripherally in the circumferential direction, is most frequently closed in itself or subdivided into closely adjacent circle segments, for example as FIG. 13 shows by way of example.

When dimensioning such a wiper lip, considerable attention has to be paid with regard to the diameter of the stem with which the actual applicator section, which predominantly consists of a bristle covering, is connected to the applicator handle. A conflict of objectives is often the result especially if applicators with a bristle covering are used. If the clear internal diameter of the wiper lip of such a wiper is comparatively large, the wiper does not put up any excessive resistance when the applicator is withdrawn, but leaves a lot of cosmetic mass in the bristle covering. As soon as the clear diameter of the area enclosed by the wiper lip is made considerably smaller than the diameter of the applicator stem, the actual applicator section is wiped off in a considerably greater extent. However, the resistance that has to be overcome when the applicator is withdrawn is increased significantly at the same time.

In many cases, this conflict of objectives leads to the necessity, with regard to the design of the applicator, of having to maintain a certain diameter ratio between the applicator stem and the core of the applicator bearing the bristles, which limits the design options.

In view of this, the invention is based on the object of providing a wiper in which the ratio between intensity of the wiping action and the resistance that the wiper puts up against the withdrawal of the applicator, or of the actual applicator section, is more favorable.

The following combinations of features are proposed for accomplishing this object.

SUMMARY OF THE INVENTION

A wiper according to the invention comprises a retaining section for fixing the wiper on a cosmetics storage container. This wiper is characterized in that it comprises a number of wiper lamellas which shift in a more than just insubstantial extent in the circumferential direction solely under the influence of the forces produced by the withdrawal of the applicator. In some cases, it may already be considered a shift in the circumferential direction in a more than just insubstantial extent if the shift of all or of at least half of all wiper lamellas at their free ends is more than just 1/10 mm. In any case, if the shift is greater than 3/10 mm, it is more than just insubstantial in most cases. Ideally, a more than just insubstantial shift is a shift which, at least in the absence of a cosmetic, can be perceived by the naked eye when the applicator, which cooperates with the wiper as intended, is pulled through the latter.

In all of this, the wiper lamellas are preferably configured in a rod-like manner, i.e. their extent in the longitudinal direction is substantially greater than their extent in the circumferential direction.

Preferably, the wiper comprises a number of wiper lamellas that are each configured as rods, whose extent in their longitudinal direction EL is greater by at least the factor 5, better by at least the factor 10, than their maximum extent EU in the circumferential direction.

Within the context of another preferred embodiment, it is provided that each wiper lamella has an extent in the radial direction which is greater than its extent in the circumferential direction. In this case, the following preferably applies: $ER \geq 1.3 \times EU$; and ideally: $ER \geq 1.6 \times EU$.

Preferably, the wiper lamellas, or the rods forming them, respectively extend along a helical line. In this case, the radial distance of the wiper lamellas, or of the rods, from the imaginary center line L of the wiper preferably decreases as viewed from the proximal end of the wiper in the direction towards the distal end of the wiper.

This orientation facilitates the shift of the wiper lamellas, or the rods that form them, in the circumferential direction and, optionally, also in the radially inward direction under the influence of the forces applied by the applicator.

An embodiment in which the wiper lamellas, seen from the inside of a storage container, block the clear internal cross section of the retaining section 2 substantially completely is also preferred. A very pronounced wiping action with favorable friction conditions can be obtained in this way.

Preferably, the tips of the wiper lamellas taper to a point, ideally in such a way that the local extent in the circumferential direction, and preferably also the local extent in the radial direction ER, assumes very small values which are less than a quarter and preferably less than a fifth of the corresponding extent of the rod to be found at its proximal end. This enables the tips to deflect the bristle covering, without exerting a large amount of force, in such a way that the bristles increasingly insert into the intermediate spaces between the wiper lamellas. Wiper lamellas that taper to a point at their end are thus superior to wiper lamellas that are "cut off bluntly" at their ends.

Within the context of another preferred embodiment, it is provided that the wiper comprises six or eight wiper lamellas which are preferably disposed uniformly distributed on the circumference of its retaining section. Particularly if the wiper lamellas have only a limited extent in the circumferential direction, such a number of wiper lamellas ensures that, on the one hand, the distance between the wiper lamellas is close enough to ensure an effective wiping action, and, on the other hand, that enough of a distance remains between the adjacent wipers for them to shift in the circumferential direction without hindrance under the influence of the forces exerted by the applicator when it is withdrawn.

Within the context of a particularly preferred exemplary embodiment, it is provided that the wiper lamellas are designed in such a way that, due to the forces that the applicator, or its bristles, exert on them when the applicator is withdrawn, they are elastically bent in a more than just insubstantial extent also in the radially inward direction and thus shift also in the radially inward direction. In some cases, which are at first included into the scope of protection, it may already be considered a shift in the radial inward direction in a more than just insubstantial extent if the shift of all or of at least half of all wiper lamellas at their free ends is more than just 1/10 mm. In any case, if the shift is greater than 3/10 mm, it is more than just insubstantial in most cases. Also in this case, a more than just insubstantial shift ideally is a shift which, at least in the absence of a cosmetic, can be perceived by the naked eye when the applicator, which cooperates with the wiper as intended, is pulled through the latter.

In general, protection is sought not only for a wiper, but also for a cosmetics unit which comprises an applicator and a storage container and is equipped with one of the above-described wipers and preferably also with an applicator.

As an alternative and preferably, but not exclusively totally independently from what protection is sought for so far, protection is also sought for a cosmetics unit comprising a wiper for wiping the associated cosmetics applicator, which has a retaining section for fixing the wiper on a cosmetics storage container, wherein this further wiper is characterized in that it comprises a number of wiper lamellas respectively configured in such a way that adjacent wiper lamellas, over at least 25% of their extent in the longitudinal direction, have a distance from each other in the circumferential direction that corresponds to at least the maximum extent of one of these wiper lamellas in the circumferential direction. Wiper lamellas designed in this way also produce a novel, very positive wiping effect, already just because of the large intermediate spaces between adjacent wiper lamellas, which lead to each of the wiper lamellas being capable of very effectively "scraping" excess cosmetic mass out of the bristle covering and conveying it outwards. The wiper lamellas are capable of doing so on their own without further requirements having to be made of them, or instead due to them consisting of a plastic material of such flexibility that it realizes the spring effect laid down by the first main claim in such a design, which substantially enhances the wiping action. Preferably, adjacent wiper lamellas have such a distance in the circumferential direction even over at least 50%, or ideally even at least 70% of their extent in the longitudinal direction.

Preferably, the wipers for which protection is sought comprise a number of wiper lamellas that are each configured in such a way that their extent in their longitudinal direction is greater by at least the factor 5, better by at least the factor 10, than their maximum extent in the circumferential direction.

Further advantages, effects and optional embodiments of the wipers according to the invention, for which protection is sought herein, and of the cosmetics units equipped with a respective wiper become apparent from the following description of the exemplary embodiments, which are explained with reference to FIGS. 1 to 10.

BRIEF DESCRIPTION OF THE DRAWINGS

FIG. 1 shows a side view of a first exemplary embodiment of the wiper according to the invention, inserted into the neck of a bottle serving as a cosmetics storage container.

FIG. 2 shows a perspective side view of the first exemplary embodiment of the wiper according to the invention.

FIG. 3 shows a perspective side view of the first exemplary embodiment of the wiper according to the invention in a section along the longitudinal wiper axis L.

FIG. 4 shows a top view of the first exemplary embodiment seen from the inside of the storage container.

FIG. 5 shows a top view of the first exemplary embodiment seen from outside the storage container.

DETAILED DESCRIPTION OF THE PREFERRED EMBODIMENTS

Figure 10:
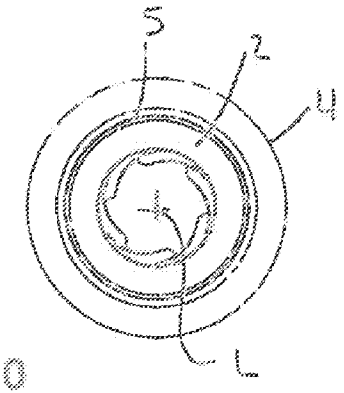
FIG. 10 shows a top view of the second exemplary embodiment seen from outside the storage container.
Figure 8:
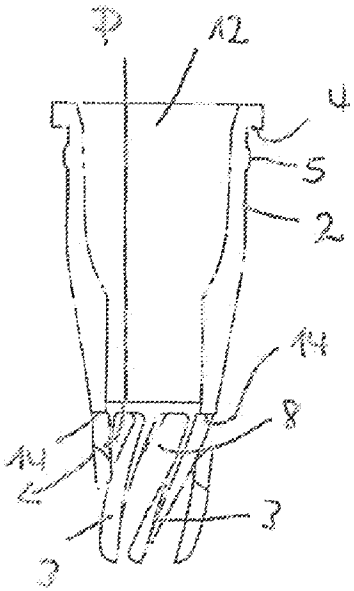
FIG. 8 shows a perspective side view of the second exemplary embodiment of the wiper according to the invention in a section along the longitudinal wiper axis L.
Figure 7:
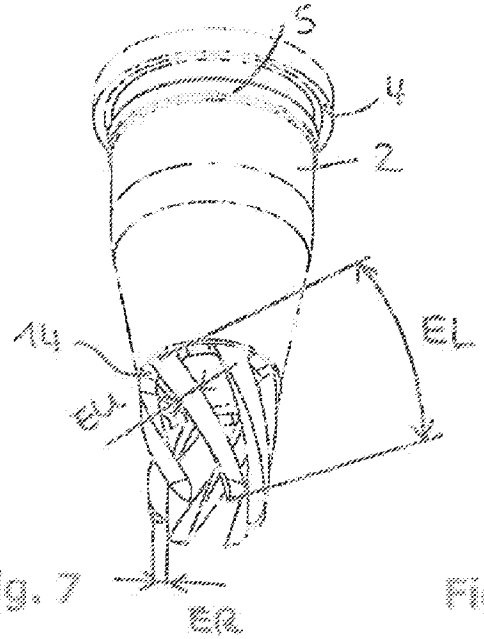
FIG. 7 shows a perspective side view of the second exemplary embodiment of the wiper according to the invention.
Figure 9:
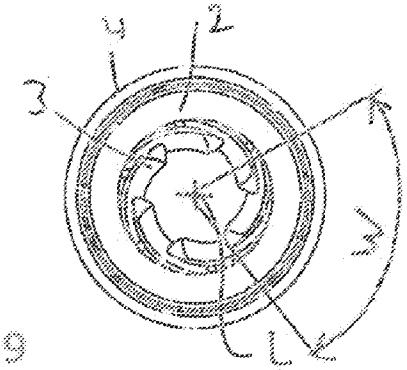
FIG. 9 shows a top view of the second exemplary embodiment seen from the inside of the storage container.
Figure 6:
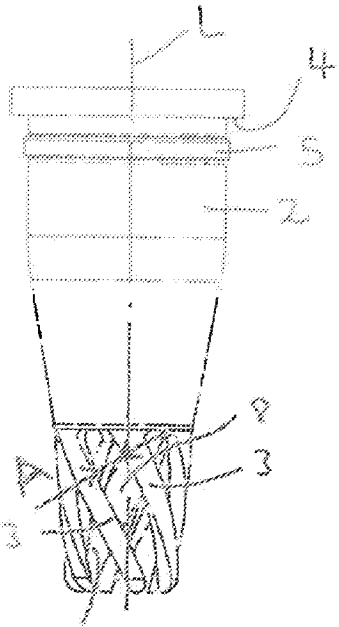
FIG. 6 shows a side view of a second exemplary embodiment of the wiper according to the invention.

FIGS. 1 to 4 show a first exemplary embodiment of the invention.

As can be seen rather well in FIG. 1, the component of the first exemplary embodiment, which in its entirety is referred to as wiper 1, consists of a retaining section 2 and a number of wiper lamellas 3 which are attached to the distal side of the retaining section, i.e. the side facing towards the inside of the storage container, and together form the actual wiping organ of this wiper. Where the wiper is used for mascara applicators, the external diameter of this retaining section is most frequently less than 10 mm. It follows that the wiper is, on the whole, very delicate where it is used as a mascara wiper.

In this exemplary embodiment, the wiper lamellas are longer in the direction of the longitudinal axis L of the wiper than the retaining section 2.

Ideally, at least 6 or 8 wiper lamellas are provided along the circumference; in the predominant number of cases, there is no sense in having more than 10 wiper lamellas. In individual cases, the invention can also be realized with fewer wiper lamellas; thus, it was found in experiments that 5 wiper lamellas, for example, may suffice in certain cases.

In general, the use of the terms "distal" and "proximal" hereafter is supposed to mean that the distal side is the side facing towards the inside of the storage container, whereas the proximal side is the side facing towards the removal opening of the storage container.

The wiper lamellas 3 interact with the bristle covering of the applicator when it is withdrawn from the cosmetics supply, and thus wipe off the excess cosmetic. The wiper lamellas exhibit such a wiping action at least to a certain extent even in cases in which the applicator is not equipped with a bristle covering, but rather with a sponge-like covering, for example.

As it is preferred, the retaining section 2 is in this case configured as a tubular body which is closed in itself in the circumferential direction, by means of which the wiper 1 is fixed in the neck of the bottle which in this case serves as the cosmetics storage container. For this purpose, the retaining section 2 is preferably provided with a collar-like stop 4, which abuts against an end face of the bottle neck and thus limits the distance by which the wiper 1 can be inserted into the bottle neck. As can be seen, the retaining section 2 is additionally provided with at least one latching organ 5 which latches to a corresponding latching organ or a corresponding surface of the bottle neck.

The external diameter of the retaining section 2 is generally adapted to the internal diameter of the bottle neck provided for accommodating it, in order thus to ensure a clearance-free seat of the wiper 1 also in the radial direction. In this exemplary embodiment, the retaining section 2 has a substantially constant internal diameter. Depending on how this internal diameter was selected in relation to the applicator diameter, the retaining section 2 as such either does not contribute to the wiping action in any substantial degree, or it makes a contribution by its end faces 14 wiping off another part of the cosmetic mass, or "combing it out" of the bristle covering. The latter embodiment is preferred.

In this exemplary embodiment, the wiper lamellas are not formed as bowls that form a cylinder section or cone section, which naturally has a high geometrical moment of inertia in the circumferential direction and there does not yield, or yields only minimally, at least in the circumferential direction. Instead, the wiper lamellas are configured as rods that, seen in the circumferential direction, are slim. Their extent in their longitudinal direction EL is greater by at least the factor 5, better by at least the factor 10, than their maximum extent EU in the circumferential direction, see FIG. 2.

At the same time, each rod has an extent in the radial direction ER which is greater than its extent in the circumferential direction EU. This leads to each rod putting up a larger resistance to bending in the radial outward direction than to bending directed in the generally circumferential direction. Apart from local discontinuities, and preferably even without exception, the following preferably applies: $ER \geq 1.3 \times EU$. Ideally, even the following applies: $ER \geq 1.6 \times EU$. The aforementioned condition is by no means obligatory for the area of the distal end or "tip" of each rod, i.e. on the last 20% of the length of a rod.

Preferably, the extent of each rod in the circumferential direction EU is substantially or even completely the same over the predominant part of the length of a rod, i.e. the "thickness" of the rod, seen in the circumferential direction, is the same everywhere in the area mentioned.

The rods are not straight, but respectively extend along a helical line. In this case, the radial distance of the rods from the imaginary center line L of the wiper decreases from the proximal end of the wiper towards the distal end of the wiper, see in particular FIG. 4.

Preferably, the rods also do not touch at their distal ends but enclose a substantially circular clear cross section 7 between one another. This clear cross section can be very small and then blocks the clear internal cross section of the retaining section 2 substantially completely. If the wiper according to the invention is used for wiping off an applicator with a bristle covering, the diameter of this clear cross section 7 can preferably substantially correspond to the diameter of the core from which the bristles protrude. Alternatively, the diameter of the clear cross section can be selected to be relatively large and make up, for example, 80% to 120% of the diameter of the stem which connects the applicator and its handle.

The rods forming the lamellas do not adjoin each other so closely that they laterally support each other once forces acting in the circumferential direction are applied to them. Instead, rods that are directly adjacent in the circumferential direction maintain, over the predominant part of their length, a distance A from each other which corresponds to at least 1.5 times and preferably at least 2 times the maximum extent EU that the rods concerned have in the circumferential direction. A generous intermediate space 8 is created in this way between directly adjacent lamellas, respectively. When determining the maximum extent EU, the base area in which the rods transition into the retaining section 2 while forming a rounded portion or hollow, see FIG. 1, is not taken into account. In the area of the distal end of the rods, the distance A will generally be lower than the above-mentioned measure, see FIGS. 1 and 4. However, these Figures also show that this distance A falls short over about the last third, or preferably only over the last quarter, of adjacent rods.

The tips of the rods preferably taper in a point, i.e. the local extent in the circumferential direction EU and preferably also the local extent in the radial direction ER there assumes very small values. These are values, in particular, that, for example, approach "zero" or at least less than ⅕ of the respective extent that is to be found at the proximal end of the rod, see FIG. 4.

The wiper according to the invention shows its advantages particularly when wiping off bristle-covered applicators, and especially when wiping off bristle-covered wire-core applicators. Nevertheless, it may also be advantageous to a certain extent when wiping off other applicators.

The wiper according to the invention is preferably configured in such a way that, when wiping off bristle-covered applicators and especially bristle-covered wire-core applicators, it behaves as follows:

As long as the applicator is still in its storage position, the tips of the wiper lamellas formed by said rods still rest against the applicator stem. Once the applicator has been withdrawn from its storage position to a sufficient extent, said tips of the wiper lamellas start combing the bristle covering. A large part of the bristles is thereby respectively caused to insert into one of the intermediate spaces 8. Because the intermediate spaces 8 are also wound in a helical shape and the user will inadvertently hold on to the applicator when withdrawing it, thus preventing it from rotating, the bristles, which at first have come to lie in a first intermediate space 8, will be forced during the further withdrawal of the applicator to "slip through" under the closest wiper lamella and to insert into the adjacent intermediate space. In the process, the bristles are perceptibly wiped off by a part of the cosmetic mass, which has so far been entrained by them, being caught on the wiper lamella and then conveyed outwards, as a rule. Depending on the design of the lamellas, this process can repeat itself several times during the withdrawal of the applicator. In view of this, it is clear that the intensity with which the applicator is wiped off can be adjusted very well by the selection of the length of the wiper lamellas.

Preferably, the wiper lamellas are designed in such a way that, due to the forces that the applicator, or its bristles, exerts on them, they are elastically bent in the circumferential direction and thus shift also in the circumferential direction. This is accompanied, generally synchronously, by a shift in the radial inward direction, at least in the area of the distal end of the wiper lamellas.

This tends to increase the contact pressure of the wiper lamellas against the applicator or its bristles, so that a sort of "servo effect" occurs, as it were—the intensity of the wiping tends to increase automatically. In many cases, this occurs without the resistance to which the applicator is exposed during withdrawal being significantly increased. At their radially inward side, the wiper lamellas are ideally contoured and, with regard to their elasticity, designed in such a way that the entire existing contact surface between the wiper lamellas and the applicator is increased by the shift of the wiper lamellas in the circumferential direction.

Figure 12:
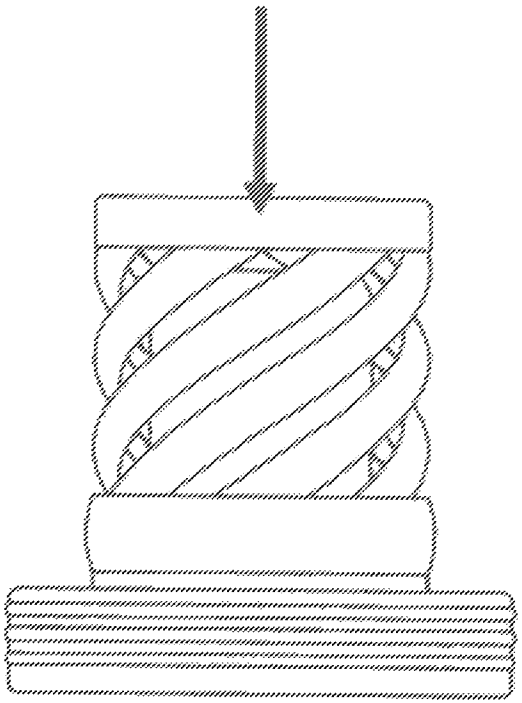
FIGS. 11 and 12 illustrate the deformation behavior that the wiper lamellas of the two previously described exemplary embodiments exhibit under the influence of the forces produced by the applicator during its withdrawal, with reference to generally known prior art, specifically referring to the example of a stopper for a tablet tube.
Figure 11:
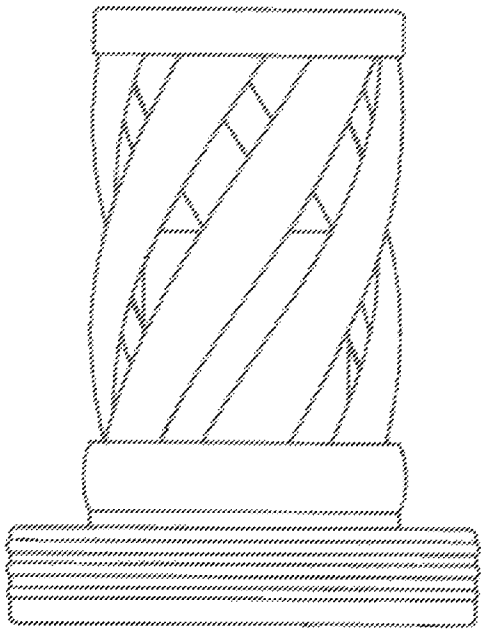
Figure 13:
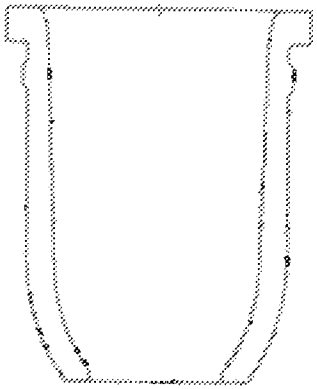
FIG. 13 shows an annular wiper as it is known from the prior art.

For greater clarity, the effect which preferably occurs can be compared to the behavior of the following, generally known standard stopper for tablet tubes used by many pharmaceutical companies. For example, the company Ratiopharm GmbH, of Ulm, Germany, for many years has sold its medicament ASS+C Brausetabletten (effervescent tablets) in tablet tubes provided with such a stopper. FIGS. 11 and 12 show such a stopper.

As can best be seen in FIG. 11, such a stopper is equipped with a spring member for retaining the entire tablet charge of the tube in a rattle-free manner. Said spring member consists of a number of rods, which respectively extend along a helical line extending along the circumferential surface of an imaginary cylinder. At the distal end of the stopper, the rods lead into a circular ring. The rods can be compared with the wiper lamellas of the wiper according to the invention, which are also formed by rods, whereas there is generally no equivalent in the invention to the circular ring of the stopper, and the rods also mostly do not extend along the circumferential surface of an imaginary cylinder in the invention, but rather along the circumferential surface of a body of revolution, which is conical or which has a diameter that decreases in another manner towards the distal end of the wiper.

If such a stopper is pressed together in the direction of its longitudinal axis, i.e. in the direction of the arrow shown in FIG. 11, then said rods shift in the circumferential direction as is made very clear by FIG. 11. In the process, the clear internal diameter of the cavity, which is enclosed by the rods and in this case is, at first, cylindrical, tends to decrease. The rods which form the wiper lamellas of the wiper according to the invention behave in exactly the same way.

It is also worth mentioning that the wiper built in accordance with this first exemplary embodiment, in contrast to the conventional solitary wipers that work with a wiper lip which is in an annular contact with the applicator, does not tend to seal the storage container to a large extent during the withdrawing process. Instead, it always leaves a path open through which air can flow from the wiper antechamber 12 into the storage container, so that no distracting negative pressure is able to build up in the storage container when the applicator is being withdrawn and the "popping effect", which is distracting for the reasons mentioned below, substantially fails to appear.

Moreover, it is worth mentioning that the wiper lamellas have a centering effect on the applicator when the applicator is reinserted into the storage container or the wiper, due to the fact that their radial distance from the imaginary center line L of the wiper decreases towards their distal end. Almost automatically, the applicator is oriented in such a way that its bristle-covered core substantially penetrates the clear cross section 7 instead of having to displace the wiper lamellas in a lasting manner and thus putting up a perceptible resistance to reinsertion.

Finally, for the sake of completeness, it is noted that each wiper lamella, seen in the projection in the direction of the longitudinal axis L, takes on the shape of an arc along the circumference, which is preferably smaller or equal to the arc of a circle spanned by two legs that include an angle of 50° between them.

FIGS. 6 to 10 show a second exemplary embodiment of the invention.

This is characterized by the series arrangement of two wiping organs. The first wiping organ is formed by a number of wiper lamellas 3 which are configured in accordance with the above statements regarding the wiper lamellas of the first exemplary embodiment, with the exception of the differences described in more detail below. The retaining section 2 is configured in accordance with the above statements regarding the retaining section of the first exemplary embodiment, with the exception of the differences described in more detail below. The statements made above with regard to the first exemplary embodiments therefore equally apply to this second exemplary embodiment unless otherwise stated below.

Also in this second exemplary embodiment, the wiper lamellas are not formed as bowls that form a cylinder section or cone section, which yield only minimally in the circumferential direction. Instead, they are again configured as rods which, seen in the circumferential direction, are slim, and for whose dimensions the above statements apply. In their totality, the rods form a first wiping organ which acts on the applicator as described above. Also in this exemplary embodiment, the rods are not straight, but respectively extend along a helical line. Preferably also in this exemplary embodiment, the radial distance of the rods from the imaginary center line L of the wiper in this case decreases from the proximal end of the wiper towards the distal end of the wiper, even though significantly less sharply than in the first exemplary embodiment, see FIGS. 8 and 4.

Preferably, the rods also do not touch at their distal ends but enclose a substantially circular clear cross section 7 between one another, but preferably do not block the clear internal cross section of the retaining section 2 to a large extent, but leave open a clear cross section whose diameter is at least 10%, better at least 20% smaller than, for example, the core diameter of a bristle-covered section of the applicator.

Moreover, the retaining section 2 in this exemplary embodiment is formed in such a way that it tapers towards the inside of the container and forms a circular wiper lip 13, which is closed in itself in the circumferential direction and provides a second subsequent wiping organ 10. For this purpose, the retaining section 2 is shaped in a conical manner at the end thereof inside the container.

Preferably, the wiper lip thus formed additionally comprises a conical chamfer on the last part of its outer circumference. The wiper lamellas, which are injection-molded onto the retaining section 2, protrude from this chamfer, or the last part of the outer circumference of the retaining section.

Because the applicator section is first wiped off by the first wiping organ 9 while being withdrawn through the wiper, it reaches the second wiping organ 10 with a significantly smaller charge than is the case with the single-stage wiper. This reduces the tendency of the applicator to seal the storage chamber of the cosmetics container in the area of the wiper lip 13 against the influx of air from the area of the wiper antechamber 12 as far as possible. This reduces the otherwise always imminent danger of a significant negative pressure being produced in the storage container during the withdrawal of the applicator, which collapses abruptly once the applicator has passed the circular wiper lip 13 almost completely, and which then leads to an acoustically and haptically unpleasant "popping effect", or even to the cosmetic mass squirting out.

Therefore, the provision in the side wall of the retaining section 2 of, for example, one of the bypass openings which are supposed to serve for venting the storage container, and which most frequently are not without problems because they tend to clog, can preferably be dispensed with the applicator according to the invention. On the contrary, if the wiper lip 13 is dimensioned in such a way that it rests against the stem of the applicator with a slight radial bias also in the storage position, a wiper is obtained which reliably seals the inner space of the storage container and which causes the stored cosmetic not to be able to pass the wiper even if the cosmetics unit is stored, for example, upside-down at high temperatures, which may involuntarily happen in a handbag.

Preferably, the wiper in both exemplary embodiments is a component which is integrally injection-molded from a single plastic.

Within the context of a third exemplary embodiment which is not shown in the Figures, it is provided that the wiper is injection-molded from two different plastics. For example, the retaining section, which is subject only to slight mechanical stress, can be injection-molded from a comparatively unsophisticated and correspondingly inexpensive plastic, onto which the wiper lamellas, which are exposed to greater stresses, are injection molded from another, higher-quality or more elastic plastic.

Despite their comparatively complex geometry, the wipers described herein are comparatively easy to manufacture. Particularly in cases where the wiper lamellas are configured without undercuts in the direction of the longitudinal axis L so that the elasticity and deformability of the wiper lamellas can be used to pull them out in the direction of the longitudinal axis L from the mold cavities which give them their shape, without having to split these mold cavities.

The invention claimed is:

1. A wiper for wiping off a cosmetics applicator comprising:

a retaining section for fixing the wiper on a cosmetics storage container, wherein the wiper comprises a plurality of wiper lamellas which shift in a more than just insubstantial extent in a circumferential direction solely under an influence of forces produced by withdrawal of the applicator, and wherein each wiper lamella, viewed in a direction of a projection of a longitudinal axis, takes on a shape of an arc along the circumference that is smaller or equal to an arc of a circle spanned by two legs that include and angle of 50° between them.

2. The wiper according to claim 1, wherein the plurality of wiper lamellas are each configured as rods whose extent in their longitudinal direction (EL) is greater by at least a factor of 5 than their maximum extent (EU) in the circumferential direction.

3. The wiper according to claim 2, wherein the rods respectively extend along a helical line, wherein a radial distance of the rods from an imaginary center line (L) of the wiper decreases from a proximal end of the wiper towards a distal end of the wiper.

4. The wiper according to claim 3, wherein tips of the wiper lamellas taper to a point in such a way that a local extent in a circumferential direction (EU), and also a local extent in a radial direction (ER), assumes very small values which are less than ¼ of the corresponding extent of the rod to be found at its proximal end.

5. The wiper according to claim 1, wherein each wiper lamella has an extent in a radial direction (ER) which is greater than its extent in the circumferential direction (EU), wherein the following applies: $ER \geq 1.3 \times EU$.

6. The wiper according to claim 1, wherein tips of the wiper lamellas, viewed in the direction of the projection of the longitudinal axis, block a clear internal cross section of the retaining section substantially completely.

7. The wiper according to claim 1, wherein the wiper comprises six or eight wiper lamellas which are disposed uniformly distributed on a circumference of the retaining section.

8. The wiper according to claim 1, wherein the wiper lamellas are designed in such a way that, due to forces that the applicator, or its bristles, exert on the wiper lamellas during the withdrawal of the applicator, the wiper lamellas are elastically bent in a more than just insubstantial extent also in the circumferential direction and thus shift also in the circumferential direction and/or in a radially inward direction, in such a way that the wiper lamellas come to rest against the applicator more closely, wherein the shift is greater in each case than just 1/10 mm.

9. A cosmetics unit comprising a storage container for cosmetic mass and an applicator as well as a wiper according to claim 1.

10. A cosmetics unit comprising a wiper for wiping an associated cosmetics applicator, which has a retaining section for fixing the wiper on a cosmetics storage container, wherein the wiper comprises a plurality of wiper lamellas respectively configured in such a way that adjacent wiper lamellas, over at least 25% of their extent in a longitudinal direction (EL), have a distance from each other in a circumferential direction which corresponds to at least a maximum width of one of the wiper lamellas in the circumferential direction, wherein each of the wiper lamellas has a center line extending along a helical line.

11. The cosmetics unit according to claim 10, wherein the plurality of wiper lamellas are each configured in such a way that their extent in their longitudinal direction (EL) is greater by at least a factor of 5 than their maximum width in the circumferential direction.

* * * * *

UNITED STATES PATENT AND TRADEMARK OFFICE

CERTIFICATE OF CORRECTION

PATENT NO. : 8,783,987 B2
APPLICATION NO. : 13/655710
DATED : July 22, 2014
INVENTOR(S) : Daniela Kulik It is certified that error appears in the above-identified patent and that said Letters Patent is hereby corrected as shown below:

On the Title Page

Insert item --(30)
Foreign Application Priority Data
October 19, 2011 (DE) 20 2011 051 674.1--

Signed and Sealed this
Fourteenth Day of October, 2014

Michelle K. Lee

Michelle K. Lee
*Deputy Director of the United States Patent and Trademark Office*